US009037062B2

(12) United States Patent
Matsumoto et al.

(10) Patent No.: US 9,037,062 B2
(45) Date of Patent: May 19, 2015

(54) FIXING MEMBER, HEATING APPARATUS AND ELECTROPHOTOGRAPHIC IMAGE FORMING APPARATUS

(71) Applicant: CANON KABUSHIKI KAISHA, Tokyo (JP)

(72) Inventors: Mamo Matsumoto, Hiratsuka (JP); Masahito Omata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/852,581

(22) Filed: Mar. 28, 2013

(65) Prior Publication Data

US 2013/0259548 A1 Oct. 3, 2013

(30) Foreign Application Priority Data

Mar. 30, 2012 (JP) ..... 2012-080449
Mar. 26, 2013 (JP) ..... 2013-064248

(51) Int. Cl.
*G03G 15/00* (2006.01)
*G03G 15/20* (2006.01)

(52) U.S. Cl.
CPC ..... *G03G 15/2057* (2013.01)

(58) Field of Classification Search
CPC ..... G03G 15/2057
USPC ..... 399/320, 328–330, 333
See application file for complete search history.

(56) References Cited

U.S. PATENT DOCUMENTS

| | | | | |
|---|---|---|---|---|
| 7,493,061 | B2 * | 2/2009 | Hatori et al. | 399/111 |
| 8,208,844 | B2 | 6/2012 | Omata et al. | |
| 2007/0147915 | A1 * | 6/2007 | Kishino et al. | 399/329 |
| 2010/0221444 | A1 * | 9/2010 | Kaplan et al. | 427/425 |
| 2011/0003118 | A1 * | 1/2011 | Ohtsu et al. | 428/141 |
| 2011/0053063 | A1 * | 3/2011 | Kadota et al. | 430/48 |
| 2011/0082260 | A1 | 4/2011 | Omata et al. | |

FOREIGN PATENT DOCUMENTS

JP 2005-212318 A 8/2005

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

A fixing member is provided which is excellent in durability and hardly undergoes the peeling of the surface layer even when used in a heating apparatus over a long term. The fixing member is an electrophotographic fixing member including a substrate, an elastic layer, an intermediate layer and a fluororesin-containing surface layer. The elastic layer includes a silicone rubber and sodium ions, and the intermediate layer includes an amino group-containing polysiloxane. The surface layer is formed by forming, on the intermediate layer, a primer layer including a copolymer, to which a phosphate group is bound, of tetrafluoroethylene and perfluoro(alkyl vinyl ether), forming, on the primer layer, a coating film including the copolymer of tetrafluoroethylene and perfluoro (alkyl vinyl ether) or a coating film including a copolymer of tetrafluoroethylene and hexafluoropropylene, and melting the copolymer in the primer layer and the copolymer in the coating layer.

12 Claims, 4 Drawing Sheets

FIXING MEMBER, HEATING APPARATUS AND ELECTROPHOTOGRAPHIC IMAGE FORMING APPARATUS

BACKGROUND OF THE INVENTION

1. Field of the Invention

The present invention relates to a fixing member used in an electrophotographic image forming apparatus such as a copying machine or a printer, and a heating apparatus and an electrophotographic image forming apparatus using the fixing member.

2. Description of the Related Art

The fixing member used in the heating apparatus of, for example, an electrophotographic image forming apparatus generally has an elastic layer including silicone rubber so as to avoid excessive crushing of toner and the like. Additionally, on the surface of the elastic layer, for the purpose of suppressing the adhesion of the toner and the like, a surface layer including a fluororesin is disposed. However, there is a problem such that the adhesion between the surface layer including a fluororesin and the elastic layer is low.

For the purpose of solving such a problem, Japanese Patent Application Laid-Open No. 2005-212318 proposes the inclusion of a metal oxide in an elastomer substrate and the formation of a fluororesin coating layer including a phosphate group on the substrate. Japanese Patent Application Laid-Open No. 2005-212318 also discloses that such a constitution allows the phosphate group and the metal oxide to interact with each other so as to achieve a sufficient adhesive strength between the fluororesin and the elastomer substrate. In addition, Japanese Patent Application Laid-Open No. 2005-212318 also proposes a further formation of a fluororesin layer through the intermediary of the fluororesin coating layer so as to form a laminate, and discloses that in such a constitution, the fluororesin coating layer and the fluororesin layer have affinity to each other, and hence the fluororesin coating layer functions as the primer for the fluororesin layer.

On the basis of the disclosure of Japanese Patent Application Laid-Open No. 2005-212318, the present inventors have investigated a fixing member that uses the fluororesin coating layer having a phosphate group as a primer in the formation of the fluororesin layer on a silicone rubber layer including alumina as a metal oxide. Consequently, when the fixing member was used for thermal fixing of electrophotographic images over a long term, the interfacial peeling between the surface layer including the fluororesin and the elastic layer including the silicone rubber sometimes occurred. In other words, it has been found that there is still room for improving the adhesion durability between the surface layer and the silicone rubber.

SUMMARY OF THE INVENTION

Accordingly, the present invention is directed to providing a fixing member hardly undergoing the peeling in the interface between the surface layer thereof including a fluororesin and the lower layer thereof, and being excellent in durability, even when used in a thermal fixing apparatus over a long period of time, and a process for producing the same.

Further, the present invention is directed to providing a thermal fixing apparatus capable of stably performing the thermal fixing of electrophotographic images over a long term. Further, another object of the present invention is directed at the provision of an electrophotographic image forming apparatus capable of stably forming high-quality electrophotographic images over a long term.

According to one aspect of the present invention, there is provided a fixing member to be used in an electrophotographic apparatus, comprising a substrate, an elastic layer, an intermediate layer and a surface layer including a fluororesin, in this order, wherein the elastic layer comprises a silicone rubber and sodium ions; the intermediate layer comprises an amino group-containing polysiloxane; and the surface layer is formed by forming, on the surface of the intermediate layer opposite to the surface facing the elastic layer, a primer layer including a copolymer of tetrafluoroethylene and perfluoro (alkyl vinyl ether), to which a phosphate group is bound, forming, on the primer layer, a coating film comprising a copolymer of tetrafluoroethylene and perfluoro(alkyl vinyl ether) or a coating film comprising a copolymer of tetrafluoroethylene and hexafluoropropylene, and melting the copolymer of tetrafluoroethylene and perfluoro(alkyl vinyl ether) in the primer layer and the copolymer of tetrafluoroethylene and perfluoro(alkyl vinyl ether) or the copolymer of tetrafluoroethylene and hexafluoropropylene in the coating layer.

According to another aspect of the present invention, there is provided a heating apparatus comprising the afore-mentioned fixing member.

According to further aspect of the present invention, there is provided an electrophotographic image forming apparatus using the afore-mentioned heating apparatus.

According to still further aspect of the present invention, there is provided a process for producing a fixing member to be used in an electrophotographic apparatus, the fixing member comprising a substrate, an elastic layer, an intermediate layer and a surface layer comprising a fluororesin, in this order, the elastic layer comprising a silicone rubber and sodium ions, the intermediate layer comprising an amino group-containing polysiloxane; the process comprising the steps of: forming, on the surface of the intermediate layer opposite to the surface facing the elastic layer, a primer layer comprising a copolymer of tetrafluoroethylene and perfluoro (alkyl vinyl ether), to which a phosphate group is bound, forming, on the primer layer, a coating film comprising a copolymer of tetrafluoroethylene and perfluoro(alkyl vinyl ether) or a coating film comprising a copolymer of tetrafluoroethylene and hexafluoropropylene, and melting the copolymer of tetrafluoroethylene and perfluoro(alkyl vinyl ether) in the primer layer and the copolymer of tetrafluoroethylene and perfluoro(alkyl vinyl ether) or the copolymer of tetrafluoroethylene and hexafluoropropylene in the coating layer to form the surface layer.

Further features of the present invention will become apparent from the following description of exemplary embodiments with reference to the attached drawings.

DESCRIPTION OF THE EMBODIMENTS

Figure 1A:
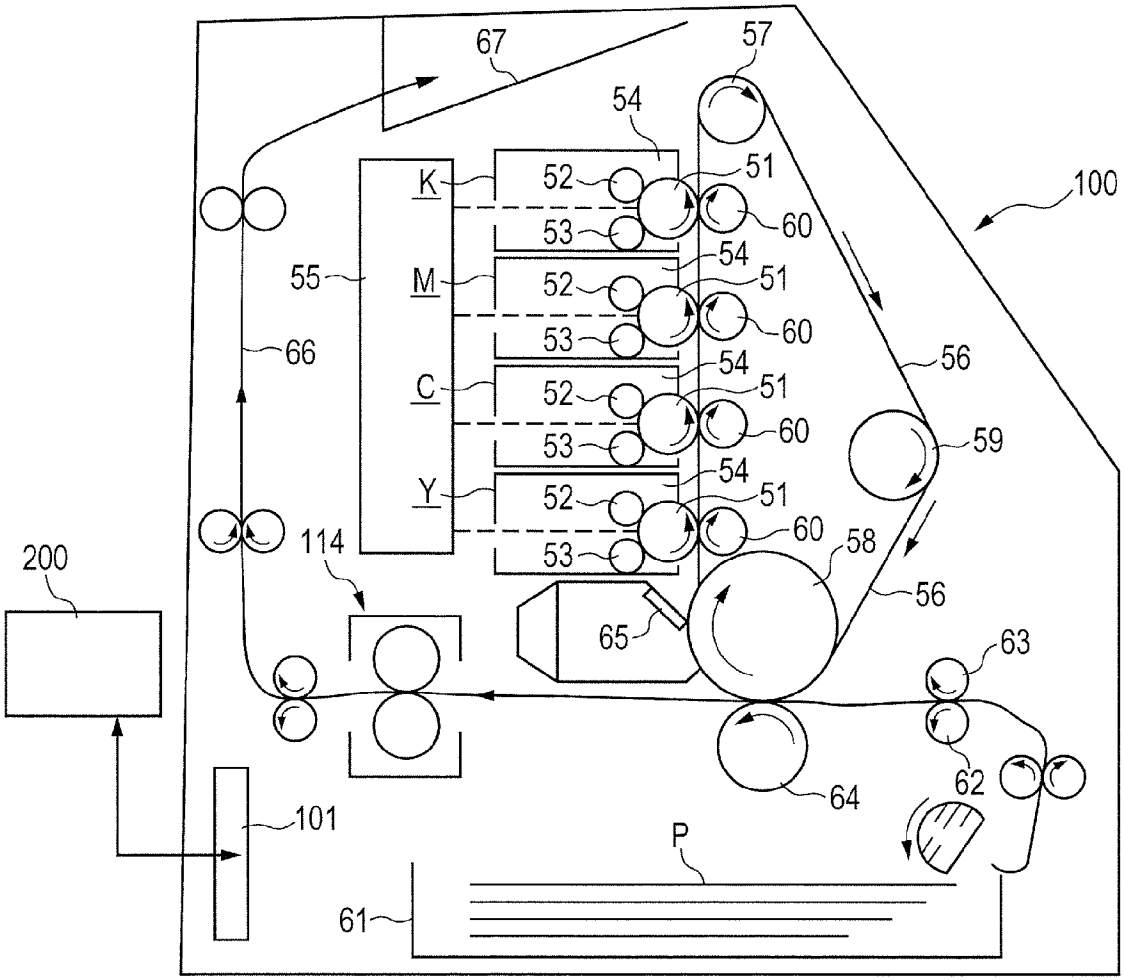
FIG. 1A is a cross-sectional view illustrating an example of the electrophotographic image forming apparatus according to the present invention.

Preferred embodiments of the present invention will now be described in detail in accordance with the accompanying drawings.

The present inventors have investigated the causes for peeling of the surface layer due to a long term use, for the fixing member to which the invention according to Japanese Patent Application Laid-Open No. 2005-212318 was applied. Consequently, the present inventors have elucidated that the sodium ions included in the elastic layer make one of the causes. Specifically, the elastic layer includes a filler dispersed therein to regulate the thermal conductivity thereof. Alumina common as such a filler includes sodium ions as impurities. Accordingly, the elastic layer using alumina as a filler includes a large amount of sodium ions.

On the other hand, the fixing member in the heating apparatus is exposed to a high temperature of approximately 200° C. to 250° C. As has been elucidated, in this case, the sodium ions in the elastic layer penetrate into the phosphate group-containing primer layer to decrease the adhesive force between the surface layer and the elastic layer.

Accordingly, in view of such technical findings, the present inventors have made a series of investigations for the purpose of alleviating the effect exerted by the sodium ions in the elastic layer on the adhesion between the surface layer and the elastic layer.

Specifically, when a fluorine-containing surface layer was formed on the elastic layer, an intermediate layer including an amino group-containing polysiloxane was formed on the surface of the elastic layer. Next, a surface layer coating the intermediate layer was formed by forming on the surface of the intermediate layer, opposite to the surface facing the elastic layer, a primer layer including a copolymer, to which a phosphate group is bound, of tetrafluoroethylene and perfluoro(alkyl vinyl ether), next, on the primer layer, a coating film including a copolymer of tetrafluoroethylene and perfluoro (alkyl vinyl ether) or a coating film including a copolymer of tetrafluoroethylene and hexafluoropropylene, and by melting the copolymer of tetrafluoroethylene and perfluoro(alkyl vinyl ether) in the primer layer and the copolymer of tetrafluoroethylene and perfluoro(alkyl vinyl ether) or the copolymer of tetrafluoroethylene and hexafluoropropylene in the coating layer. In the fixing member including the surface layer formed in this way, the peeling of the surface layer from the elastic layer was hardly caused even in a long term use.

In the present specification, the copolymer of tetrafluoroethylene and perfluoro(alkyl vinyl ether) is sometimes described as "PFA".

The present inventors draw the following inference about the reasons for the fact that the peeling durability of the surface layer is drastically improved by disposing the surface layer through the intermediary of the intermediate layer including an amino group-containing polysiloxane.

Specifically, in Japanese Patent Application Laid-Open No. 2005-212318, the phosphate group possessed by the fluororesin used as the primer has many oxygen atoms and hence is electrically negatively charged. Consequently, the sodium ions, which is the cations present in the elastic layer, probably tends to be attracted to the phosphate group. Thus, when many sodium ions penetrate into the primer layer in a high temperature environment, probably the adhesive improving effect due to the interaction of the phosphate group with the metal oxide in the elastic layer is inhibited to decrease the adhesive force.

On the other hand, in the present invention, the amino groups in the intermediate layer trap the sodium ions, and even when many sodium ions bleed from the elastic layer to the surface layer side, probably the sodium ions cannot easily pass through the intermediate layer.

This is considered to suppress the inhibition, by the sodium ions, of the adhesive force improving effect due to the interaction between the phosphate group in the primer and the metal oxide in the elastic layer, and accordingly the durability of the adhesive force is maintained. The present invention has been achieved on the basis of the foregoing experimental results and investigations.

(1) Electrophotographic Image Forming Apparatus

FIG. 1A is a configuration model diagram of an example of an electrophotographic image forming apparatus 100 mounting a heating apparatus 114 using a fixing film as the fixing member according to the present invention, as a fixing apparatus for fixing, through heat treatment, an unfixed toner image on a recording material. The electrophotographic image forming apparatus 100 is a color printer using an electrophotographic system. The electrophotographic image forming apparatus 100 performs the color image formation on a sheet-like recording material P as a recording medium on the basis of the electric signals input from an external host apparatus 200 such as a personal computer or an image reader into the control circuit section (control unit) 101 in the electrophotographic image forming apparatus. The control circuit section 101 includes a CPU (arithmetic section), a ROM (storage unit) and the like, and performs the transfer of various sets of electric information between the host apparatus 200 and the operation section (not shown) of the electrophotographic image forming apparatus 100. The control circuit section 101 also controls the image formation operations of the electrophotographic image forming apparatus 100 according to a predetermined control program or reference table, in an integrated manner.

Y, C, M and K are the four image forming sections forming yellow, cyan, magenta and black color toner images, respectively, and are arranged upwardly in order in the electrophotographic image forming apparatus. Each of the image forming sections, Y, C, M and K has an electrophotographic photosensitive member drum 51 as an image carrier, and the process units acting on the drum 51 such as a charging device 52, a developing device 53 and a cleaning device 54. In the developing device 53 of the yellow image forming section Y, a yellow toner as a developer is accommodated. In the developing device 53 of the cyan image forming section C, a cyan toner as a developer is accommodated. In the developing device 53 of the magenta image forming section M, a magenta toner as a developer is accommodated. In the developing device 53 of the black image forming section K, a black toner as a developer is accommodated. An optical system 55 forming an electrostatic latent image by applying photographic exposure to the drum 51 is provided for each of the four color image forming sections Y, C, M and K. As the optical system, a laser scanning exposure optical system is used. In each of the image forming sections Y, C, M and K, scanning exposure based on the image data is performed by the optical system 55 on the drum 51 uniformly charged by the charging device 52. Herewith, an electrostatic latent image corresponding to the scanning exposure image pattern is formed on the surface of the drum. Each of these electrostatic latent images is developed as the toner image by the developing device 53. Specifically, on the drum 51 of the yellow image forming section Y, a yellow toner image corresponding to the yellow component image of the full color image is formed. On the drum 51 of the cyan image forming section C, a cyan toner image corresponding to the cyan component image of the full color image is formed. On the drum 51 of the magenta image forming section M, a magenta toner image corresponding to the magenta component image of the full color image is formed.

On the drum 51 of the black image forming section K, a black toner image corresponding to the black component image of the full color image is formed. The color toner image formed on the drum 51 of each of the image forming sections Y, C, M and K is primary-transferred, in a condition aligned with one another, sequentially in a superimposed manner, on the intermediate transfer member 56 rotating at an approximately constant speed in a manner synchronized with the rotation of each of the drums 51. Herewith, an unfixed full color toner image is synthetically formed on the intermediate transfer member 56.

In the present embodiment, as the intermediate transfer member 56, an endless intermediate transfer belt is used, extended and stretched around three rollers, namely, a driving roller 57, a secondary transfer roller-opposed roller 58 and a tension roller 59, and driven by a driving roller 57.

A primary image transfer roller 60 is used as the primary transfer unit of the toner image from the drum 51 of each of the image forming sections Y, C, M and K to the belt 56. To the roller 60, from a not-shown bias power source, a primary transfer bias reverse in polarity to the polarity of the toner is applied. Herewith, the toner image is primary-transferred to the belt 56 from the drum 51 of each of the image forming sections Y, C, M and K. In each of the image forming sections Y, C, M and K, after the primary transfer from drum 51 to the belt 56, the residual toner as transfer residual toner on the drum 51 is removed by a cleaning device 54.

The foregoing operations are performed in a synchronized manner with the rotation of the belt 56, for each of the colors, yellow, cyan, magenta and black, and thus, the primary-transferred toner images of the respective colors are sequentially formed on the belt 56 in a superimposed manner. When a single color image is formed (monochromatic mode), the foregoing operations are performed only for the intended color.

On the other hand, the recording material P in the recording material cassette 61 is fed by one sheet at a predetermined timing by the feed roller 62. Then, the recording material P is conveyed by the resist rollers 63 at a predetermined timing to the transfer nip section, which is the pressure contact section between the intermediate transfer belt portion wound around the secondary transfer roller-opposed roller 58 and the secondary transfer roller 64. The primary-transferred synthetic toner image formed on the belt 56 is transferred in a lump to the sheet of the recording material P by the bias opposite in polarity to the polarity of the toner applied to the secondary transfer roller 64 by the not shown bias power supply. The secondary transfer residual toner remaining after the secondary transfer on the belt 56 is removed by the intermediate transfer belt cleaning device 65. The unfixed toner image secondary-transferred on the recording material P is melted, color-blended and fixed on the recording material P by the heating apparatus 114, and the recording material P is forwarded as a full-color print through the paper discharge path 66 to the paper discharge tray 67.

(2) Heating Apparatus

Figure 1B:
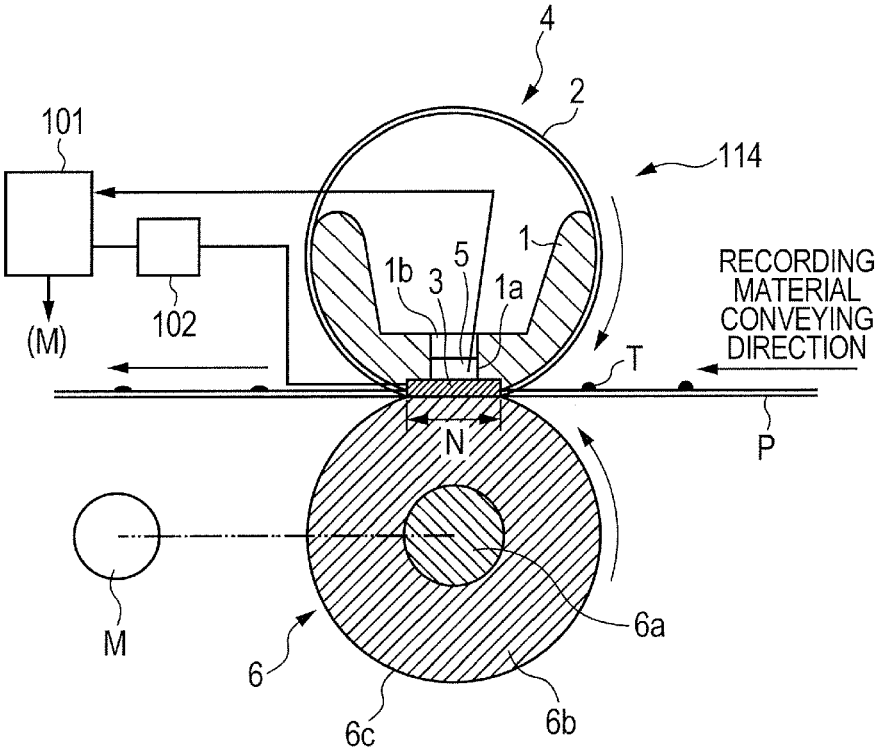
FIG. 1B is a cross-sectional view illustrating an example of the heating apparatus according to the present invention.

FIG. 1B is a schematic cross-sectional view illustrating the principal section of the heating apparatus 114 including an endless belt-like fixing film as the fixing member according to the present invention and a heater disposed inside the fixing film. In the following description, with respect to the heating apparatus and the members constituting the heating apparatus, the lengthwise direction is the direction in the recording material plane and perpendicular to the conveying direction of the recording material. The widthwise direction is the direction in the recording material plane and parallel to the conveying direction of the recording material. The width is the dimension in the widthwise direction. The length is the dimension in the lengthwise direction.

The heating apparatus 114 in the present embodiment is fundamentally a film heating-type heating apparatus, which is of a so-called tension-less type based on a heretofore known technique. The film heating-type heating apparatus of this type uses as the fixing member a flexible endless belt-like or cylindrical heat-resistant fixing film 2. And, this heating apparatus is an apparatus in such a way that at least a fraction of the perimeter of the fixing film 2 is designed to be always tension-free, namely, to be in a state of no applied tension, and the fixing film 2 is disposed in contact with a pressure roller (pressure rotation member) 6 and is dependently rotated by the rotation driving force of the pressure roll 6. In the present embodiment, the fixing film 2 as the fixing member is the film based on the constitution according to the present invention.

In FIG. 1B, the stay 1 doubles as a heating member supporting member and the film guiding member. The stay 1 is a rigid heat-resistant resin member extending in the lengthwise direction (the direction normal to the figure plane) and having a cross section of a nearly semicircular gutter shape. In the present embodiment, a highly heat-resistant liquid crystal polymer was used as the material for the stay 1. In the vicinity of the center in the lengthwise direction of the stay 1, a hole 1*b* for housing a thermistor (temperature detecting element) 5 disposed so as to be in contact with the heater 3 is provided so as to be communicatively connected to the groove 1*a*. As the heater 3, for example, a ceramic heater can be used. The heater 3 is fixed in and supported by the groove 1*a* formed in the lengthwise direction of the stay 1, in the center in the widthwise direction, and on the underside of the stay 1. The cylindrical, heat-resistant fixing film 2 as the fixing member, flexible and excellent in heat resistance is loosely fit onto the outer periphery of the stay 1 made to support the heater 3, with some tolerance in the peripheral length. Further, a grease is applied onto the inner peripheral surface (inner surface) of the fixing film 2, for the purpose of improving the sliding in relation to the heater 3. The heating assembly 4 includes the stay 1, the heater 3, the fixing film 2 and others. The pressure roller (pressure rotation member) 6 serves as a backup member. The pressure roller 6 in the present embodiment is a member prepared by coating a round shaft core metal 6*a* made of, for example, iron, stainless steel or aluminum with a silicone foam as a heat-resistant elastic layer 6*b*, and by further coating the heat-resistant elastic layer 6*b* with a fluororesin tube as a surface layer 6*c*. The pressure roller 6 is opposed to the heater 3 supported by the stay 1 across the fixing film 2. The pressure mechanism (not shown) applies a predetermined pressure to between the stay 1 and the pressure roller 6. This pressure causes an elastic deformation of the elastic layer 6*b* of the roller 6, along the heater 3 across the fixing film 2 in the lengthwise direction. This elastic deformation allows the roller 6 to form a nip section (fixing nip section) N, between the roller 6 and the heater 3 across the fixing film 2, having a predetermined width required for the thermal fixing of the unfixed toner image T carried by the recording material P.

The pressure roller 6 is, at least at the time of forming an electrophotographic image, rotation-driven at a predetermined speed in the anticlockwise direction shown by an arrow, by a motor (a driving unit) M controlled by the control circuit section 101. The frictional force between the pressure roller 6 and the fixing film 2, in the nip section N, due to the rotation of the pressure roller 6 applies a torque to the fixing film 2. Accordingly, the fixing film 2 is rotated in the clockwise direction shown by an arrow, around the outer periphery of the stay 1 at a peripheral speed nearly corresponding to the rotational peripheral speed of the pressure roller 6, with the inner surface of the fixing film 2 sliding on the surface of heater 3 in close contact with the surface of the heater 3 in the nip section N. In other words, the fixing film 2 is rotated at a peripheral speed nearly equal to the conveying speed of the recording material P, conveyed from the image transfer section, carrying the unfixed toner image T. The heater 3 is raised in temperature by the electric power supplied from the power supply 102. The temperature of the heater 3 is detected with thermistor 5. A set of information about the temperature detected by the thermistor 5 is feed backed to the control circuit section 101.

The control circuit section 101 controls the electric power to be input to the heater 3 from the power supply 102 in such a way that the detected temperature input from the thermistor 5 is maintained at a predetermined target temperature (fixing temperature). Under the condition that the heater is heated to a predetermined fixing temperature and regulated in temperature and additionally the roller 6 is rotation-driven, the recording material P having an unfixed toner image T is introduced into the nip section N so as for the toner image carrying surface of the recording material P to face the fixing film 2.

The recording material P, in the nip section N, is in close contact with the outer surface of the fixing film 2, and the recording material P is conveyed together with the fixing film 2 so as to pass through the nip section N in a sandwiched manner. In this way, the heat of the heater 3 is imparted to the recording material P through the intermediary of the fixing film 2, the pressurizing force of the nip section N is imparted to the recording material P, and the unfixed toner image T is hot press-fixed on the surface of the recording material P. The recording material P having passed through the nip section N is spontaneously separated from the outer peripheral surface of the fixing film 2 to be conveyed to outside the heating apparatus.

(3) Structure of Fixing Film

Figure 2:
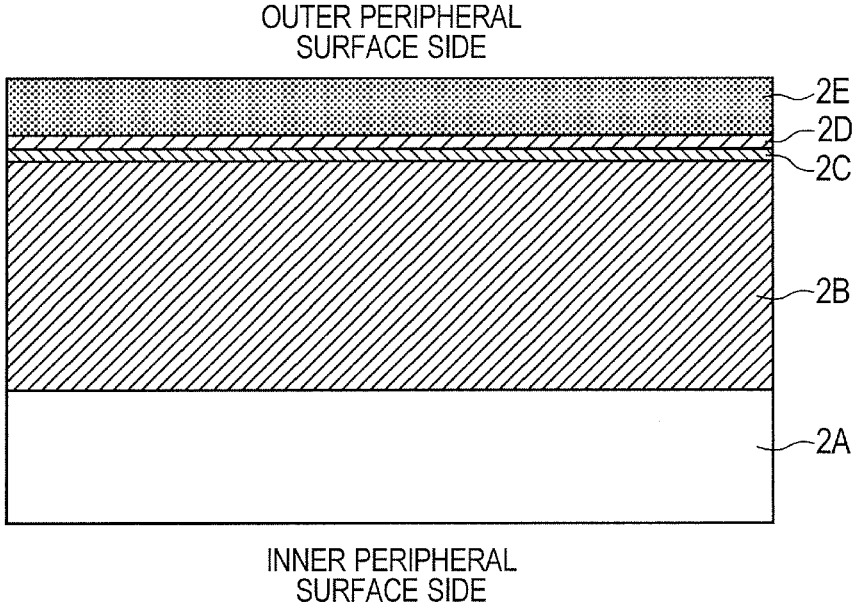
FIG. 2 is a schematic cross-sectional view illustrating the layered structure of a fixing film as a fixing member.

FIG. 2 is a schematic cross-sectional view illustrating the layered structure of a section of the fixing film 2 as the fixing member in the heating apparatus 114. The fixing film 2 includes the substrate 2A, which is an endless belt substrate made of a metal or a heat-resistant resin. In the fixing film 2, the thinner the total thickness thereof the better, for the purpose of reducing the heat capacity and thus improving the quick start capability; the thinner the thickness of the substrate 2A, the more advantageous for the quick start of the heating apparatus 114. Accordingly, also in consideration of the strength as a film, the thickness of the substrate 2A is preferably set at 20 to 100 μm.

On the outer peripheral surface of the substrate 2A, the elastic layer 2B is formed. The elastic layer 2B has a role to transfer heat from the heater 3 to the recording material P or the unfixed toner image T by following the raised and recessed portions of the recording material P or the unfixed toner image T in a manner wrapping the raised and recessed portions. Also, the thinner the thickness of the elastic layer 2B, the more advantageous for the quick start of the heating apparatus 114. Accordingly, also in consideration of the effect of wrapping the recording material P or the toner, the thickness of the elastic layer 2B is set within a range from 50 μm to 1 mm and particularly preferably set within a range from 80 μm to 300 μm.

The fixing film 2 has the surface layer 2E, which is made of a fluororesin having satisfactory release properties for the purpose of avoiding the offset of the toner T on the recording material P. Between the elastic layer 2B and the surface layer 2E, the intermediate layer 2C and the primer layer 2D are provided. For the purpose of facilitating the transfer of the heat from the heater 3 to the recording material P and the toner T, the total thickness of the intermediate layer 2C, the primer layer 2D and the surface layer 2E is preferably 25 μm or less.

(3-1) Substrate 2A

For the substrate 2A, the following materials can be used: metals such as SUS, nickel and nickel alloys; additionally, thermosetting resins such as polyimide and polyamideimide having properties such as heat resistance, strength and durability.

(3-2) Elastic Layer 2B

The elastic layer 2B includes a silicone rubber. In the formation of the elastic layer, it is preferable to use an addition-curable silicone rubber, which is excellent in workability. Specifically, by forming on the substrate a layer of a liquid silicone rubber mixture including the addition-curable silicone rubber and the below-described filler, and by curing the resulting layer, an elastic layer made of the foregoing mixture can be formed.

(3-2-1) Addition-Curable Silicone Rubber

In general, the addition-curable silicone rubber includes an organopolysiloxane having an unsaturated aliphatic group, an organopolysiloxane having active hydrogen bonded to silicon, and a platinum compound as a cross-linking catalyst. Specific examples of the organopolysiloxane having an unsaturated aliphatic group include the following organopolysiloxanes (a) and (b).

(a) A linear organopolysiloxane in which each of both molecular terminals is represented by $(R1)_2(R2)SiO_{1/2}$, and the intermediate units are represented by $R1_2SiO$ and R1R2SiO.

(b) A branched organopolysiloxane in which each of both molecular terminals is represented by $(R1)_2(R2)SiO_{1/2}$, and the intermediate units include the moieties represented by (R1) $SiO_{3/2}$ or $SiO_{4/2}$.

Here, R1 represents a monovalent unsubstituted or substituted hydrocarbon group bonded to a silicon atom, containing no aliphatic unsaturated group. Specific examples of R1 are as follows:

Alkyl groups (for example, methyl, ethyl, propyl, butyl, pentyl and hexyl)

Aryl groups (for example, phenyl group)

Substituted hydrocarbon groups (for example, chloromethyl, 3-chloropropyl, 3,3,3-trifluoropropyl, 3-cyanopropyl and 3-methoxypropyl)

Among these, 50% or more of the R1 groups are preferably methyl groups, and particularly preferably all the R1 groups are methyl groups, because of easiness in synthesis and handling, and because of achieving excellent heat resistance.

R2 represents an unsaturated aliphatic group bonded to a silicon atom. Specific examples of R2 include a vinyl group, an allyl group, a 3-butenyl group, a 4-pentenyl group and a 5-hexenyl group. Among these, a vinyl group is preferable because of easiness in synthesis and handling, and because of its easy cross-linking reaction.

The organopolysiloxane having active hydrogen bonded to silicon functions as a cross-linking agent for forming a cross-linking structure through the reaction with the alkenyl group of the organopolysiloxane component having an unsaturated aliphatic group, with the aid of the catalytic action of a platinum compound. The number of the hydrogen atoms bonded to silicon atoms is a number exceeding three on average in a molecule. Examples of the organic group bonded to a silicon atom include substituted or unsubstituted monovalent hydrocarbon groups falling within the same range as the range for the R1 in the organopolysiloxane component having an unsaturated aliphatic group. In particular, the organic group bonded to a silicon atom is preferably a methyl group because of easiness in synthesis and handling. The molecular weight of the organopolysiloxane having active hydrogen bonded to silicon is not particularly limited.

The viscosity of the involved organopolysiloxane at 25° C. is preferably within a range of 10 $mm^2/s$ or more and 100,000 $mm^2/s$ or less and more preferably within a range of 15 $mm^2/s$ or more and 1,000 $mm^2/s$ or less. This is because the viscosity falling within the above-described ranges prevents the evaporation during storage leading to failure in attaining the intended degree of cross-linking and the intended physical properties of the molded product, and provides the easiness in synthesis and handling and the easiness in uniform dispersion in the involved system.

As the organopolysiloxane, even an organopolysiloxane having any of linear, branched and cyclic structures can be used. Alternatively, a mixture of the organopolysiloxanes having these structures may also be used. Among these, because of easiness in synthesis, a linear organopolysiloxane is particularly preferably used.

The Si—H bond may be present in any of the siloxane units in the molecule; however, preferably, at least a fraction of the Si—H bonds is present in the molecular terminal siloxane units such as the $(R1)_2HSiO_{1/2}$ unit. As the addition-curable silicone rubber, an addition-curable silicone rubber in which the proportion of the unsaturated aliphatic groups is 0.1 mol % or more and 2.0 mol % or less in relation to 1 mol of silicon atoms is preferable. An addition-curable silicone rubber in which the proportion of the unsaturated aliphatic groups is 0.2 mol % or more and 1.0 mol % or less in relation to 1 mol of silicon atoms is particularly preferable. These organopolysiloxanes are preferably mixed in such proportions that allow the number ratio of the active hydrogen to the unsaturated aliphatic group to be 0.3 or more and 0.8 or less. The number ratio of the active hydrogen to the unsaturated aliphatic group can be quantitatively determined and derived by the measurement using the hydrogen nuclear magnetic resonance analysis (a measurement using a 1H-NMR spectrometer such as the FT-NMR spectrometer, model AL400 (trade name) manufactured by JEOL Ltd.). By setting the number ratio of the active hydrogen to the unsaturated aliphatic group so as to fall within the foregoing numerical range, the hardness of the silicone rubber layer after the curing can be made stable, and the excessive increase of the hardness is suppressed.

(3-2-2) Filler in Elastic Layer 2B and Thermal Conductivity of Elastic Layer As the highly thermally conductive filler to be included in the rubber material of the elastic layer 2B, the materials such as alumina and zinc oxide are preferable from the viewpoint of the thermal conductivity and the cost; these can be used each alone or as mixtures thereof. For the purpose of achieving a sufficient fixability, it is preferable to include a highly thermally conductive filler in the elastic layer in such a way that the thermal conductivity of the elastic layer is to be 0.7 W/m·K or more and 2.0 W/m·K or less.

(3-2-3) Presence of Sodium Ions

The cause for the occurrence of the problems according to the present invention involves a premise that the elastic layer according to the present invention includes sodium ions. In this connection, alumina and zinc oxide include sodium as an impurity at the time of manufacture. As a result, sodium ions are contained in the elastic layer including alumina or zinc oxide as dispersed therein.

(3-3) Intermediate Layer 2C

On the elastic layer 2B, as the intermediate layer 2C, a layer including an amino group-containing polysiloxane is formed. The intermediate layer 2C takes on a role of blocking the migration of the sodium ions present in the elastic layer 2B with the aid of the amino group in the intermediate layer 2C, and a role of effecting the adhesion between the elastic layer 2B and the primer layer 2D through the intervention between these two layers, due to the formation of the intermediate layer 2C from a silane coupling agent. The intermediate layer 2C is formed by applying an amino silane coupling agent and by hydrolyzing and condensing the amino silane coupling agent.

(3-4) Primer Layer 2D

The primer layer 2D is formed on the surface of the intermediate layer 2C opposite to the surface of the intermediate layer 2C facing the elastic layer. The primer layer 2D constitutes the surface layer together with the fluororesin in the below-described coating film formed on the primer layer 2D.

The primer layer 2D includes a copolymer, to which a phosphate group is bound, of tetrafluoroethylene and perfluoro(alkyl vinyl ether).

In the present constitution, the siloxane bond possessed by the polysiloxane in the intermediate layer 2C and the phosphate group interact with each other to develop strong adhesive force.

The copolymer, to which a phosphate group is bound, of tetrafluoroethylene and perfluoro(alkyl vinyl ether) can be obtained, for example, by copolymerizing a fluorinated monomer having a phosphate group-containing pendant side group when the fluororesin is produced by polymerization. Preferable examples of the fluorinated monomer having a phosphate group may include a trifluorovinyl ether group-containing dihydrogen phosphate ester compound. Specific examples of such a compound may include 2,2,3,3,5,6,6,8,9,9-decafluoro-5-trifluoromethyl-4,7-dioxanona-8-en-1-yl dihydrogen phosphate (EVE-P), and may also include 2,2,3,3,4,4,6,7,7-nonafluoro-5-oxahepta-6-en-1-yl dihydrogen phosphate.

The fluororesin is a copolymer obtainable by copolymerizing tetrafluoroethylene (TFE) with at least a perfluoro(alkyl vinyl ether) by a heretofore known method.

Examples of perfluoro(alkyl vinyl ether) may include: a perfluoroalkylvinyls each having 3 to 8 carbon atoms and perfluoro(alkyl vinyl ethers) (PAVEs) in which the alkyl group has 1 to 5 carbon atoms.

The copolymer (PFA) of TFE and perfluoro(alkyl vinyl ether) and the copolymers of TFE and perfluoroalkylvinyls are preferable fluororesins. The phosphate group-containing fluororesin is obtained by copolymerizing a phosphate group unit-containing fluorinated monomer when the fluororesin is produced by polymerization. The melting point of the phosphate group-containing fluororesin is 200 to 300° C. and preferably 220 to 280° C.; for that purpose, the proportion of the alkyl vinyl ether component or the alkylvinyl component is within a range from 3 to 15 mol % and preferably within a range from 5 to 12 mol % in relation to the copolymer.

The primer layer 2D may include a fluororesin having no phosphate group.

The concomitant presence of the fluororesin to which a phosphate group is bound and the fluororesin having no phosphate group in the primer layer 2D allows the content of the phosphate group in the primer layer 2D to be easily and optionally regulated.

As the fluororesin having no phosphate group, for example, the TFE-perfluoroalkyl vinyl ether copolymer and the TFE-perfluoroalkyl vinyl copolymer are preferably used. The copolymer having the proportion of the alkyl vinyl ether component or the alkyl component of 3 to 15 mol % and preferably 5 to 12 mol % in relation to the copolymer is preferable from the viewpoint of having a desirable melting point.

The fluororesin having a phosphate group is mixed preferably in a proportion of 10 to 100% by weight and particularly preferably in a proportion of 30 to 80% by weight in relation to the mixture of the fluororesin having a phosphate group and the fluororesin having no phosphate group. The melting point of the mixture of the fluororesin having a phosphate group and the fluororesin having no phosphate group is preferably set at 200 to 300° C. and particularly preferably set at 220 to 280° C. so that the elastic layer may not be degraded by heat when the fluororesin coating film is formed in the below-described formation of the surface layer.

The content of the phosphate group in the mixture of the fluororesin having a phosphate group and the fluororesin having no phosphate group in relation to the mixture is preferably 0.02 to 5.00 mol %, particularly preferably 0.10 to 2.50 mol % and furthermore preferably 0.20 to 1.00 mol %. When the primer layer is formed, a coating material is used which is the dispersion prepared by dispersing the mixture as a fine powder in a water medium.

(3-5) Surface Layer 2E

The surface layer 2E is formed by forming a coating film including the copolymer of tetrafluoroethylene and perfluoro (alkyl vinyl ether) or a coating film including the copolymer of tetrafluoroethylene and hexafluoropropylene, and by melting the copolymer of tetrafluoroethylene and perfluoro(alkyl vinyl ether) in the involved primer layer and the copolymer, in the coating film, of tetrafluoroethylene and perfluoro(alkyl vinyl ether) or the copolymer, in the coating film, of tetrafluoroethylene and hexafluoropropylene.

Among these, the copolymer (PFA) of tetrafluoroethylene and perfluoro(alkyl vinyl ether) has a melting point of 280° C. to 320° C., has extremely satisfactory heat resistance and is satisfactory in workability, and hence is particularly preferable as a coating film material used for the formation of the surface layer.

(4) Method for Producing Fixing Film (4-1) Formation of Elastic Layer 2B

Figure 3:
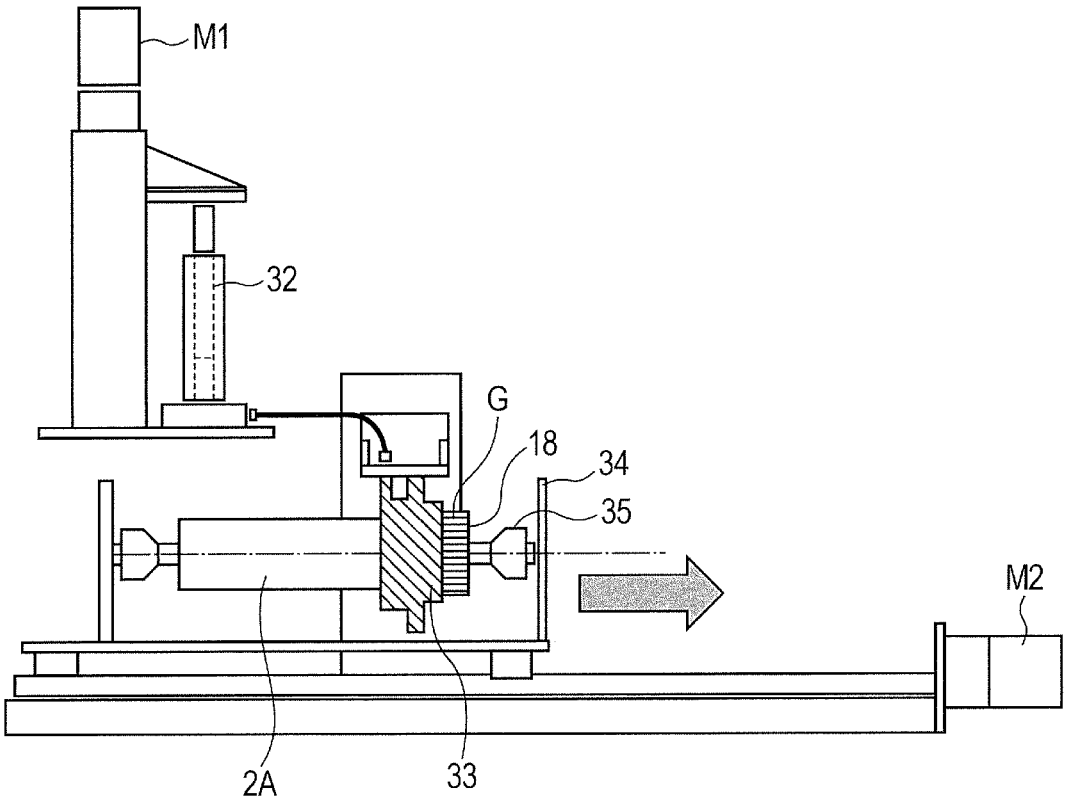
FIG. 3 is a schematic view of a ring coating machine for producing the fixing film.

The elastic layer 2B is formed on the substrate 2A beforehand subjected to a primer treatment. As the method for forming the elastic layer 2B, the ring coating method can be used. FIG. 3 illustrates an example of the step of forming the silicone rubber layer to be the elastic layer 2B on the substrate 2A, and is a schematic view illustrating the so-called ring coating method. The substrate 2A which is an endless belt member is made to cover a cylindrical core member 18 having a perfect circle cross section and having a peripheral length of the circle nearly equal to the inner peripheral length of the substrate 2A, and the substrate 2A is mounted on the core member 18. Next, the core member 18 mounted with the substrate 2A is fixed to the movable stage 34 with a chucking attachment 35. The liquid silicone rubber mixture including the addition-curable silicone rubber and the highly thermally conductive filler is filled in a cylindrical pump 32. And, the mixture is pressure-fed by a pressure feed motor M1, and thus the mixture is applied from a nozzle 33 to the peripheral surface of the substrate 2A.

In this case, simultaneously with the coating, the substrate 2A and the core member 18 together with the movable stage 34 to which the core member 18 is fixed are moved by a driving motor M2 at a constant speed to the right in the figure (as indicated by an arrow). Thus, the coating film of the addition-curable silicone rubber composition G to be the elastic layer 2B can be formed on the whole area of the outer peripheral surface of the substrate 2A. The thickness of the coating film to be the elastic layer 2B can be controlled by the clearance between the coating liquid feed nozzle 33 and the surface of the substrate 2A, the feed speed of the silicone rubber composition, the movement speed of the substrate 2A (the stage 34) and others.

The liquid silicone rubber mixture formed on the substrate 2A can be cured into the elastic layer 2B, by heating the mixture for a definite period of time with a heretofore known heating unit such as an electric furnace or an infrared heater to allow cross-linking reaction to proceed. The method for forming the elastic layer 2B is not limited to the ring coating method. For example, it is also possible to use a method in which a metal layer is coated in a uniform thickness with a material such as a liquid silicone rubber by a method such as the blade coating method, and the material is cured by heating. Alternatively, a method in which a material such as a liquid silicone rubber is injected into a mold to be heat cured, a method in which after extrusion molding, heat curing is performed, and a method in which after injection molding, heat curing is performed.

(4-2) Pretreatment of Surface of Elastic Layer

It is preferable to pretreat the surface of the elastic layer 2B before the formation of the intermediate layer 2C. For example, it is desirable to perform hydrophilization treatment such as UV treatment (ultraviolet irradiation treatment). The UV treatment is not essential, but this treatment forms OH groups on the surface of the elastic layer, and accordingly increases the sites of the successively performed reaction of the elastic layer with the amino silane coupling agent, and consequently the adhesive force between the elastic layer and the intermediate layer can be achieved.

(4-3) Formation of Intermediate Layer 2C

In the method for forming the intermediate layer 2C, an amino silane coupling agent is applied to the surface of the elastic layer 2B, pretreated in the forgoing (4-2). For example, an amino silane coupling agent is uniformly applied to the surface of the elastic layer 2B, and dried in an environment of normal temperature and normal humidity. As the amino silane coupling agent, for example, aminopropyltriethoxysilane and aminopropyltrimethoxysilane can be used.

On the surface treated with such an amino silane coupling agent, the coating film including the below described material for the primer layer and the material for forming the surface layer is formed and dried. Then, the coating film is baked to make the amino silane coupling agent undergo hydrolysis and dehydration condensation reaction; and thus, finally, the intermediate layer 2C which is a layer of a amino group-containing siloxane is formed on the surface of the elastic layer 2B.

(4-4) Formation of Primer Layer and Formation of Coating Film for Forming Surface Layer After the intermediate layer of the amino group-containing silane coupling agent, applied on the surface of the elastic layer, is dried or while the intermediate layer is still in a slightly wet condition, the aqueous dispersion (coating material) of the primer is applied with a spray to the surface of the intermediate layer of the silane coupling agent and dried to form the primer layer 2D. The thickness of the primer layer 2D after drying is set at approximately 1 to 2 μm.

Further, on the resulting surface, a coating film of a fluororesin material for forming the surface layer is formed. The method for forming the coating film of the fluororesin material for forming the surface layer 2E is not particularly limited as long as the method forms a smooth coating film leveled on the surface of a roller so as to be low in the degree of asperities. Specific examples of the application method include spray coating and dipping. The thickness of the coating film is preferably set at 4 μm or more and 25 μm or less.

(4-5) Baking

The baking unit of the coating film may be a unit capable of heating at least to a temperature equal to or higher than the melting point of the fluororesin included in the primer and the coating film and preferably to a temperature of the foregoing melting point+20 to 50° C. Examples of the baking unit include a baking unit in which high temperature air is locally produced, for example, with a hot air circulating electric oven, an infrared heater heating by radiation, or a cylindrical or coil-like heat generator and an object to be baked is made to pass through the locally hot air.

However, the elastic layer 2B under the surface layer 2E usually does not have a heat resistance comparable with the heat resistance of the fluororesin, and hence the baking is required to be performed with the baking unit and under the baking conditions, capable of achieving the film formability of the surface layer and capable of suppressing as much as possible the degradation of the elastic layer, in a manner making the release layer and the elastic layer compatible with each other. The baking melts the fluororesin material in the primer layer, namely, the copolymer of tetrafluoroethylene and perfluoro(alkyl vinyl ether), the fluororesin in the coating film, namely, the copolymer of tetrafluoroethylene and perfluoro(alkyl vinyl ether) or the copolymer of tetrafluoroethylene and hexafluoropropylene. Herewith, the fixing member according to the present invention is obtained in which the intermediate layer including an amino group-containing polysiloxane and the surface layer including the fluororesin are laminated.

The heating apparatus according to the present invention is not limited to the heating apparatus used in an electrophotographic image forming apparatus, and includes, for example, a gloss increasing device for increasing the gloss of an image by heat treating the image fixed on a recording material and an apparatus for drying, through heat treating, the recording material having an image formed by ink jet. Additionally, the fixing member according to the present invention is a concept including, for example, the fixing roller, the fixing film and the pressure roller used in the heating apparatus.

According to the present invention, it is possible to obtain a fixing member hardly undergoing the peeling of the surface layer even when used over a long term. Additionally, according to the present invention, it is also possible to obtain a heating apparatus and an electrophotographic image forming apparatus capable of performing thermal fixing of electrophotographic images stably over a long term.

EXAMPLES

Hereinafter, the present invention is specifically described with reference to Examples, but the present invention is not limited only to these Examples.

Example 1

(A) Formation of Elastic Layer of Fixing Film

As the substrate 2A, a metal belt (flexible endless belt member) made of SUS of 240 mm in length, 40 μm in thickness and 30 mm in outer diameter was used. On the outer peripheral surface of the belt, a primer (trade name: DY35-051, manufactured by Dow Corning Toray Co., Ltd.) was applied thinly and uniformly in an area of 230 mm in length (the area exclusive of both ends of 5 mm in width). The coated belt was placed in an electric oven and dried at 200° C. for 30 minutes.

The elastic layer 2B was formed as follows. First, with the addition-curable liquid silicone rubber composition, alumina (trade name: Alumina Beads CB-A10S, manufactured by Showa Denko K.K.) was mixed as a thermal conductive filler in a content of 48% by volume. By using the obtained silicone rubber composition, a 10-mm thick silicone rubber sheet was prepared, and the thermal conductivity of the sheet was measured by using a hot disc thermal conductivity analyzer (trade name: TPA-501, manufactured by Kyoto Electronics Manufacturing Co., Ltd.). Consequently, the thermal conductivity was found to be 1.3 W/m·K.

Next, the liquid silicone rubber composition was applied by the ring coating method (FIG. 3) to the primer coating area of the substrate 2A, and a film of the silicone rubber of 300 μm in thickness and 230 mm in length was formed; the resulting film was subjected to a primary vulcanization for 10 minutes while the roller was being rotated and the surface temperature was being maintained at 140° C. by using an infrared heater. Next, by performing baking at 200° C. for 4 hours, the silicone rubber cylinder was subjected to secondary vulcanization while the silicone rubber cylinder (elastic layer) was being made to adhere to the SUS metal belt (substrate).

(B) Formation of Intermediate Layer

Next, the surface of the elastic layer 2B formed on the SUS metal belt 2A was UV-treated. Specifically, by using an excimer UV apparatus, the surface was UV-treated for about 100 seconds. Herewith, the water repellency of the surface of the elastic layer 2B made of silicone rubber was changed into hydrophilicity.

After the UV treatment, a liquid prepared by diluting 3-aminopropyltriethoxysilane-containing silane coupling agent (trade name: 26011, manufactured by Dow Corning Toray Co., Ltd.) by a factor of 5 by weight with ethanol was applied with a spray, and dried at normal temperature (23° C.) and normal humidity (45%) to form the intermediate layer 2C of 1.0 μm in dry thickness.

(C) Formation of Primer Layer (C-1) Preparation of Primer

After the formation of the intermediate layer 2C, a fluororesin primer, which is an aqueous dispersion, including an aqueous dispersion of the particles of the PFA resin including a phosphate group bonded thereto was produced. In this case, the content of the phosphate group in the mixture of a fluororesin having a phosphate group and a fluororesin having no phosphate group was regulated to be 0.03 mol % in relation to the mixture.

Specifically, in a 4-liter capacity stainless steel polymerization vessel, equipped with a horizontal impeller, 2.2 L of pure water containing 4.9 g of ammonium perfluorooctanoate as added thereto was placed. Oxygen was removed from inside the polymerization vessel, and the temperature inside the polymerization vessel was maintained at 85° C. Ethane was added in the polymerization vessel at a pressure difference of 0.03 MPa relative to the pressure inside the vessel. Next, as a fraction to be precharged, 104 g of perfluoroethyl vinyl ether was added, then tetrafluoroethylene was added, and the pressure inside the polymerization vessel was increased to 2.06 MPa.

In this polymerization vessel, 69 mg of ammonium persulfate dissolved in water was added. From the time at which the pressure inside the vessel was decreased by 0.03 MPa, while the pressure was being maintained at 2.06 MPa with tetrafluoroethylene, the polymerization reaction was allowed to proceed under the continuous injection of ammonium persulfate and perfluoroethyl vinyl ether into the polymerization vessel.

The polymerization was performed at a temperature of 85° C. under a pressure of 2.06 MPa. At an elapsed time of 110 minutes from the start of the reaction, a 0.6% by mass aqueous solution of 2,2,3,3,5,6,6,8,9,9-decafluoro-5-trifluoromethyl-4,7-dioxanona-8-en-1-yl dihydrogen phosphate (hereinafter, also referred to as "EVE-P aqueous solution") was added at a rate of 26 ml/min for 10 minutes. At the same time as the completion of the addition of the EVE-P solution, the stirring was stopped and the reaction was terminated.

The amounts of ammonium persulfate and perfluoroethyl vinyl ether added during the reaction were 100 mg and 84 g, respectively.

The gas remaining after the polymerization was removed from the polymerization vessel, then the polymerization vessel was opened, and thus, a clouded dispersion containing about 30% by mass of solid content was obtained. The solid contained in the clouded dispersion was coagulated by freezing and then washed with water and acetone, and dried to yield a white solid.

To the solid, 2,6,8-trimethyl-4-nonanol-ethylene oxide adduct as a surfactant was added so as to have a content of 2.0% by mass and water was added as the solvent so as to have a content of 71% by mass to prepare a fluororesin primer.

(C-2) Formation of Primer Layer

The fluororesin primer prepared in the foregoing (C-1) was spray-applied to the intermediate layer 2C, and naturally dried to form the primer layer of 2.0 μm in dry thickness.

(D) Formation of Surface Layer

Next, on the primer layer, an aqueous dispersion of PFA resin particles (trade name: HP350, manufactured by Du Pont Inc.) was spray-applied, and dried at normal temperature (23° C.) and normal humidity (45%) to form a layer of PFA resin particles. The aqueous dispersion of PFA was applied in such a way that the total thickness of the layer of PFA resin and the intermediate layer was 15 μm after the drying of the coating film of the dispersion of PFA.

The laminate prepared by forming the elastic layer, the intermediate layer, the primer layer and the layer of PFA particles in this order on the substrate was placed in an electric furnace and baked at a temperature of 330° C. for 10 minutes, to melt the primer layer and the PFA resin in the layer of PFA resin particles, and thus a 15-μm thick surface layer was formed to yield the fixing film of Example 1.

The surface of the obtained fixing film was subjected to cross-section processing by using a polisher (trade name: Cross Section Polisher (SM09010, manufactured by JEOL Ltd.) and a focused ion beam system (FIB) (trade name: FB-2100, manufactured by Hitachi High-Technologies Co., Ltd.), and thus, the primer layer was exposed.

Next, the primer layer was analyzed by using the TOF-SIMS (trade name: PHI TRIFT IV, manufactured by Ulvac Phi, Inc.) under the following conditions.

Measurement temperature: 23° C., primary ions for irradiation: Au3+ 30 kV, secondary ions for analysis: negative ions, observed mass number: 0 to 1850, measurement range: 200 μm square of primer layer Consequently, from the primer layer, the peak having a mass number corresponding to the phosphate group was detected.

Example 2

A fixing film was obtained by the same production method as in Example 1 except that a highly thermally conductive silicone rubber including zinc oxide (trade name: 1-Shu (First Grade) Zinc Oxide, manufactured by Sakai Chemical Industry Co., Ltd.) as a thermally conductive filler as beforehand mixed therein and having a thermal conductivity of about 1.0 W/m·K was used, in place of the highly thermally conductive silicone rubber used for the formation of the elastic layer 2B in Example 1.

Example 3

A fixing film was obtained by exactly the same method as the production method of Example 1 except that in the step of producing the fluororesin primer of Example 1, the polymerization was performed by using a 10% by mass of EVE-P aqueous solution in such a way that the content of the phosphate group in the mixture of the fluororesin having a phosphate group and the fluororesin having no phosphate group was 0.5 mol % in relation to the mixture.

Example 4

A fixing film was obtained by exactly the same method as the production method of Example 1 except that in the step of producing the fluororesin primer of Example 1, the polymerization was performed by using a 4.0% by mass of EVE-P aqueous solution in such a way that the content of the phosphate group in the mixture of the fluororesin having a phosphate group and the fluororesin having no phosphate group was 0.2 mol % in relation to the mixture.

Example 5

A fixing film was obtained by exactly the same method as the production method of Example 1 except that in the step of producing the fluororesin primer of Example 1, the polymerization was performed by using a 20% by mass of EVE-P aqueous solution in such a way that the content of the phosphate group in the mixture of the fluororesin having a phosphate group and the fluororesin having no phosphate group was 1.0 mol % in relation to the mixture.

Comparative Example 1

A fixing film was obtained by the same production method as in Example 1 except that the intermediate layer was not formed, and hence no silane coupling agent was applied.

Comparative Example 2

A fixing film was obtained by the same production method as in Example 2 except that the intermediate layer was not formed.

For the convenience of description, the sections formed by coating on the elastic layer by the foregoing methods (in the cases of Example 1 and Example 2, the layer assembly composed of the intermediate layer 2C, the primer layer 2D and the surface layer 2E) is referred to as the "coat layer".

Next, for the purpose of comparing the coat layers of Examples 1 and 2 with the coat layers of Comparative Examples 1 and 2, with respect to the adhesiveness in a high temperature environment, each of the fixing films of Examples 1 and 2 and Comparative Examples 1 and 2 was allowed to stand in a high temperature environment (a thermostatic chamber set at a temperature of 230° C.), and the peeling strength of the surface section of each of the fixing films was measured as a function of the time of being allowed to stand.

Figure 4:
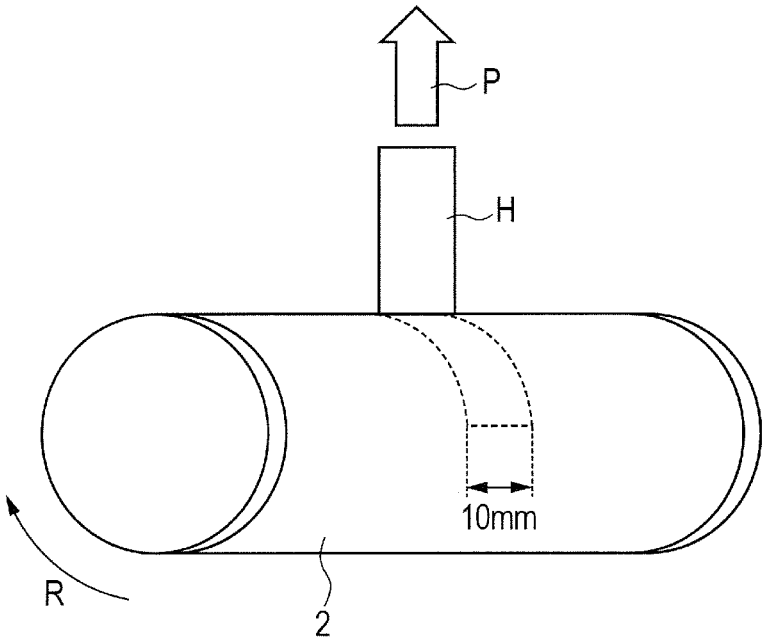
FIG. 4 is a view illustrating the measurement method of the peeling strength of the coating layer of the fixing film.
Figure 5:
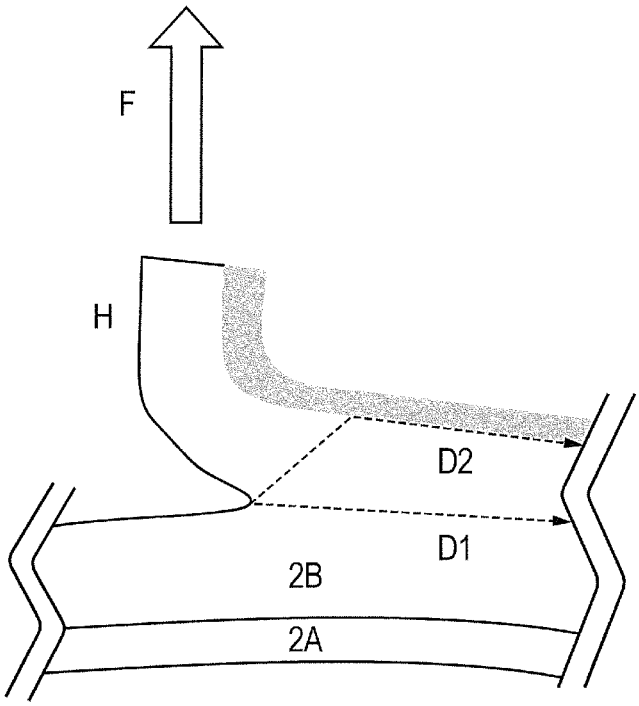
FIG. 5 is a schematic cross-sectional view illustrating the peeling end of the surface of the fixing film and the proceeding direction of the peeling in a peeling strength test.

FIG. 4 schematically illustrates the measurement method of the peeling strength. A core member (not shown) is inserted into the fixing film 2, and both ends of the core member are sandwiched by the rotatable bearings (not shown) from outside. Next, the surface section of the fixing film is peeled as shown in FIG. 5, to form the peeling end H (width: 10 mm, peripheral length: about 5 to 20 mm (a length not causing inconvenience in pulling), thickness: about 40 to 200 μm (capable of realizing a depth reaching the elastic layer)).

The force required for pulling the peeling end H vertically straight up, namely, the force required for pulling the surface section while peeling the surface section in the direction shown by an arrow in FIG. 4 at a rate of 50 mm/min was measured with a force gauge. The resulting measured value (unit: gf) is defined as the peeling strength of the coat layer.

When the forgoing method is used, the progress of the peeling from the peeling end H proceeds basically along the most brittle portion, and hence depending on the magnitudes of the adhesive force of the coat layer to the elastic layer and the cohesive force of the elastic layer, the peeling plane is varied and the meaning of the peeling strength is also varied.

Specifically, (1) in the case where the adhesive force of the coat layer to the elastic layer is stronger than the cohesive force of the elastic layer, the peeling plane proceeds (cohesive failure) into the elastic layer (in the direction D1 in FIG. 5), and the peeling strength in this situation corresponds to the cohesive force of the elastic layer.

On the contrary, (2) in the case where the cohesive force of the elastic layer is stronger than the adhesive force of the coat layer to the elastic layer, the peeling plane proceeds (interfacial peeling) in the interface between the coat layer and the elastic layer (in the direction of D2 in FIG. 5), and the peeling strength in this situation corresponds to the adhesive force of the coat layer to the elastic layer. Basically, the cohesive force of the elastic layer is not largely changed by being allowed to stand in a high temperature environment, and accordingly, even if the cohesive failure occurs at the initial state (before being allowed to stand in a high temperature environment), when the progress of the decrease of the adhesive force of the coat layer due to being allowed to stand in a high temperature environment occurs, eventually the interfacial peeling occurs.

The measurement results of the peeling strength are shown in Table 1.

Here, the sodium ion concentration is the value obtained as follows: sampling from the elastic layer a piece of rubber having a size of 5 mm×5 mm×1 mm, and subjected to secondary vulcanization at a temperature of 200° C. for 4 hours, and preparing a specimen. Then, immersing the specimen in pure water maintained at a temperature of 100° C. for 24 hours, and the total amount of the sodium ion eluted into the pure water is quantitatively determined by liquid chromatography. Next, the resulting value is divided by the weight of the specimen to yield the sodium ion concentration (unit: μg/g).

As can be seen from the results of Table 1, both of the fixing films obtained in Examples 1 to 5 are strong in the adhesive force of the coat layer to the elastic layer and undergo no interfacial peeling even when allowed to stand over a long period of time in the high temperature environment.

In both of the fixing films of Comparative Examples 1 and 2 obtained without forming the intermediate layer underwent interfacial peeling with the time of being allowed to stand in the high temperature environment and subsequently underwent the occurrence of the decrease of the peeling strength. Also as can be seen, the fixing film of Comparative Example 2 having a larger amount of sodium ions than the fixing film of Comparative Example 1 underwent the occurrence of the peeling in a shorter time than in Comparative Example 1.

The phosphate group has many oxygen atoms, and hence is electrically negatively charged, and probably the sodium ions tend to be attracted to the phosphate group. Accordingly, the decrease of the peeling strength in each of Comparative Examples may be ascribable to the inhibition of the adhesive action based on the phosphate group in the primer layer, by the sodium ions exuded from inside the rubber by being allowed to stand in the high-temperature environment.

On the other hand, as in the fixing films of Examples 1 to 5, the provision of the layer including polysiloxane, as the intermediate layer, by the silane coupling treatment based on the amino-modified silane coupling agent between the primer layer and the elastic layer probably allows the sodium ions to be trapped by the amino groups in the intermediate layer so as to inhibit easy passage of the sodium ions through the intermediate layer.

In this way, the provision of the layer including polysiloxane by performing the silane coupling treatment based on the amino-modified silane coupling agent as the intermediate

TABLE 1

| | Thickness of primer layer (μm) | Sodium ion concentration (μg/g) | Presence or absence of intermediate layer | Phosphate group concentration in mixture (mol %) | Peeling strength (gf) | | | | |
|---|---|---|---|---|---|---|---|---|---|
| | | | | | Initial stage | 50 hours | 100 hours | 150 hours | 200 hours |
| Example 1 | 2 | 20 | Present | 0.03 | 100 (Cohesive failure) | 100 (Cohesive failure) | 100 (Cohesive failure) | 100 (Cohesive failure) | 100 (Cohesive failure) |
| Example 2 | 2 | 10 | Present | 0.03 | 110 (Cohesive failure) | 110 (Cohesive failure) | 110 (Cohesive failure) | 110 (Cohesive failure) | 110 (Cohesive failure) |
| Example 3 | 2 | 20 | Present | 0.50 | 120 (Cohesive failure) | 120 (Cohesive failure) | 120 (Cohesive failure) | 120 (Cohesive failure) | 120 (Cohesive failure) |
| Example 4 | 2 | 20 | Present | 0.20 | 120 (Cohesive failure) | 120 (Cohesive failure) | 120 (Cohesive failure) | 120 (Cohesive failure) | 120 (Cohesive failure) |
| Example 5 | 2 | 20 | Present | 1.00 | 120 (Cohesive failure) | 120 (Cohesive failure) | 120 (Cohesive failure) | 120 (Cohesive failure) | 120 (Cohesive failure) |
| Comparative Example 1 | — | 20 | Absent | — | 100 (Cohesive failure) | 40 (Interfacial peeling) | 20 (Interfacial peeling) | Less than 20 (Interfacial peeling) | Less than 20 (Interfacial peeling) |
| Comparative Example 2 | — | 10 | Absent | — | 110 (Cohesive failure) | 50 (Interfacial peeling) | 30 (Interfacial peeling) | 20 (Interfacial peeling) | Less than 20 (Interfacial peeling) |

layer between the elastic layer and the primer layer prevents the decrease of the adhesive force of the coat layer and prevents the occurrence of the interfacial peeling of the coat layer.

In the foregoing description, the fixing films are taken up in Examples; however, the present invention can be applied to some other cases as long as the rollers requiring an elastic layer and a surface layer formed thereon are involved. For example, as a matter of course, the present invention can be applied to heat roller fixing-type fixing rollers.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-080449, filed Mar. 30, 2012, and 2013-064248, filed Mar. 26, 2013, which are hereby incorporated by reference herein in their entirety.

What is claimed is:

1. A fixing member to be used in an electrophotographic apparatus, comprising:

a substrate, an elastic layer, an intermediate layer, and a surface layer comprising a fluororesin, in this order, wherein:

the elastic layer comprises a silicone rubber and sodium ions;

the intermediate layer comprises an amino group-containing polysiloxane; and wherein:

the surface layer is formed by:

forming, on a surface of the intermediate layer opposite to a surface facing the elastic layer, a primer layer comprising a copolymer of tetrafluoroethylene and perfluoroalkyl vinyl ether to which a phosphate group is bound, forming, on the primer layer, a coating layer comprising a copolymer of tetrafluoroethylene and perfluoroalkyl vinyl ether or a coating layer comprising a copolymer of tetrafluoroethylene and hexafluoropropylene, and melting the copolymer of tetrafluoroethylene and perfluoroalkyl vinyl ether in the primer layer and the copolymer of tetrafluoroethylene and perfluoroalkyl vinyl ether or the copolymer of tetrafluoroethylene and hexafluoropropylene in the coating layer.

2. The fixing member according to claim 1, wherein the elastic layer is a cured product of a liquid silicone rubber mixture comprising a sodium ion-containing filler and an addition-curable silicone rubber.

3. The fixing member according to claim 2, wherein the filler is at least one selected from the group consisting of alumina and zinc oxide.

4. The fixing member according to claim 1, wherein the elastic layer has a thermal conductivity of from 0.7 W/m·K to 2.0 W/m·K.

5. The fixing member according to claim 1, wherein the fixing member is a fixing film comprising an endless belt substrate having a thickness of from 20 to 100 μm, and the elastic layer has a thickness of from 50 μm to 1 mm.

6. The fixing member according to claim 5, wherein the elastic layer has a thickness of from 80 to 300 μm.

7. A heating apparatus comprising:

the fixing member according to claim 5, a heater disposed inside the fixing member; and a pressure roller disposed in contact with the fixing member.

8. The heating apparatus according to claim 7, wherein the heater is in contact with an inner peripheral surface of the fixing member.

9. A heating apparatus comprising the fixing member according to claim 1.

10. An electrophotographic image forming apparatus comprising the heating apparatus according to claim 9 as a fixing apparatus.

11. A fixing member comprising:

a substrate, an elastic layer, an intermediate layer, and a surface layer comprising a fluororesin, in this order, wherein:

the elastic layer comprises a silicone rubber and sodium ions;

the intermediate layer comprises an amino group-containing polysiloxane; and wherein:

the surface layer is formed by:

forming, on a surface of the intermediate layer opposite to a surface facing the elastic layer, a primer layer comprising a copolymer of tetrafluoroethylene and perfluoroalkyl vinyl ether to which a phosphate group is bound, forming, on the primer layer, a coating layer comprising a copolymer of tetrafluoroethylene and perfluoroalkyl vinyl ether or a coating layer comprising a copolymer of tetrafluoroethylene and hexafluoropropylene, and melting the copolymer of tetrafluoroethylene and perfluoroalkyl vinyl ether in the primer layer and the copolymer of tetrafluoroethylene and perfluoroalkyl vinyl ether or the copolymer of tetrafluoroethylene and hexafluoropropylene in the coating layer, wherein a content of the phosphate group contained in the primer layer is 0.20 to 1.00 mol % in relation to a mixture of a fluororesin having a phosphate group and a fluororesin having no phosphate group.

12. A process for producing a fixing member to be used in an electrophotographic apparatus, the fixing member comprising:

a substrate, an elastic layer, an intermediate layer, and a surface layer comprising a fluororesin, in this order, wherein the elastic layer comprises a silicone rubber and sodium ions; and wherein the intermediate layer comprises an amino group-containing polysiloxanes, the process comprising the steps of:

forming, on a surface of the intermediate layer opposite to a surface facing the elastic layer, a primer layer comprising a copolymer of tetrafluoroethylene and perfluoroalkyl vinyl ether to which a phosphate group is bound, forming, on the primer layer, a coating layer comprising a copolymer of tetrafluoroethylene and perfluoroalkyl vinyl ether or a coating layer comprising a copolymer of tetrafluoroethylene and hexafluoropropylene, and melting the copolymer of tetrafluoroethylene and perfluoroalkyl vinyl ether in the primer layer and the copolymer of tetrafluoroethylene and perfluoroalkyl vinyl ether or the copolymer of tetrafluoroethylene and hexafluoropropylene in the coating layer to form the surface layer.

* * * * *